United States Patent [19]

Malacheski

[11] 4,012,064

[45] Mar. 15, 1977

[54] DOOR LOCK

[76] Inventor: Joseph J. Malacheski, 130 E. Division St., Wilkes-Barre, Pa. 18702

[22] Filed: Jan. 20, 1976

[21] Appl. No.: 650,706

[52] U.S. Cl. ..... 292/169.18; 292/140; 292/169

[51] Int. Cl.[2] ..... E05C 1/12

[58] Field of Search ..... 292/140, 165, 169, 169.18, 292/169.22, 1, 337, 336.3, 340, DIG. 53, DIG. 55; 70/351

[56] References Cited

UNITED STATES PATENTS

| | | | |
|---|---|---|---|
| 487,153 | 11/1892 | Orth | 292/340 X |
| 1,380,545 | 6/1921 | Edgerly | 292/340 |
| 1,484,500 | 2/1924 | Hope | 292/337 X |
| 1,981,289 | 11/1934 | Schlage | 292/337 |
| 2,233,828 | 3/1941 | Anderson | 292/165 X |
| 2,311,298 | 2/1943 | Marsh | 292/337 UX |
| 2,596,949 | 5/1952 | Welch et al. | 292/337 X |
| 2,661,977 | 12/1953 | Welch et al. | 292/337 X |
| 2,669,474 | 2/1954 | Kanell | 292/337 X |
| 2,724,607 | 11/1955 | Fisler | 292/169.18 X |
| 2,899,228 | 8/1959 | Polchinski et al. | 292/169.18 |
| 3,471,188 | 10/1969 | Hawkins | 292/140 |
| 3,623,757 | 11/1971 | Schlage | 292/1 |

*Primary Examiner*—Roy D. Frazier
*Assistant Examiner*—Thomas J. Holko
*Attorney, Agent, or Firm*—Robert K. Youtie

[57] ABSTRACT

A door lock wherein a generally U-shaped body straddles a door edge, the U-shaped body carrying a retractable bolt, actuating knobs or the like, interconnecting means between the bolt and actuating means, and suitable locking and releasing means.

2 Claims, 8 Drawing Figures

FIG. 1
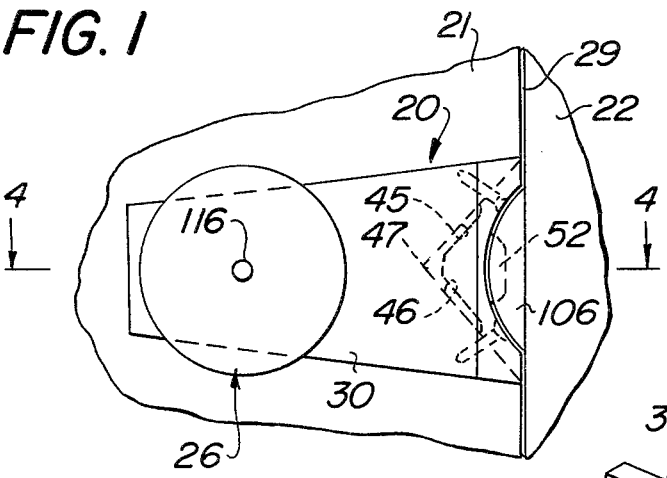
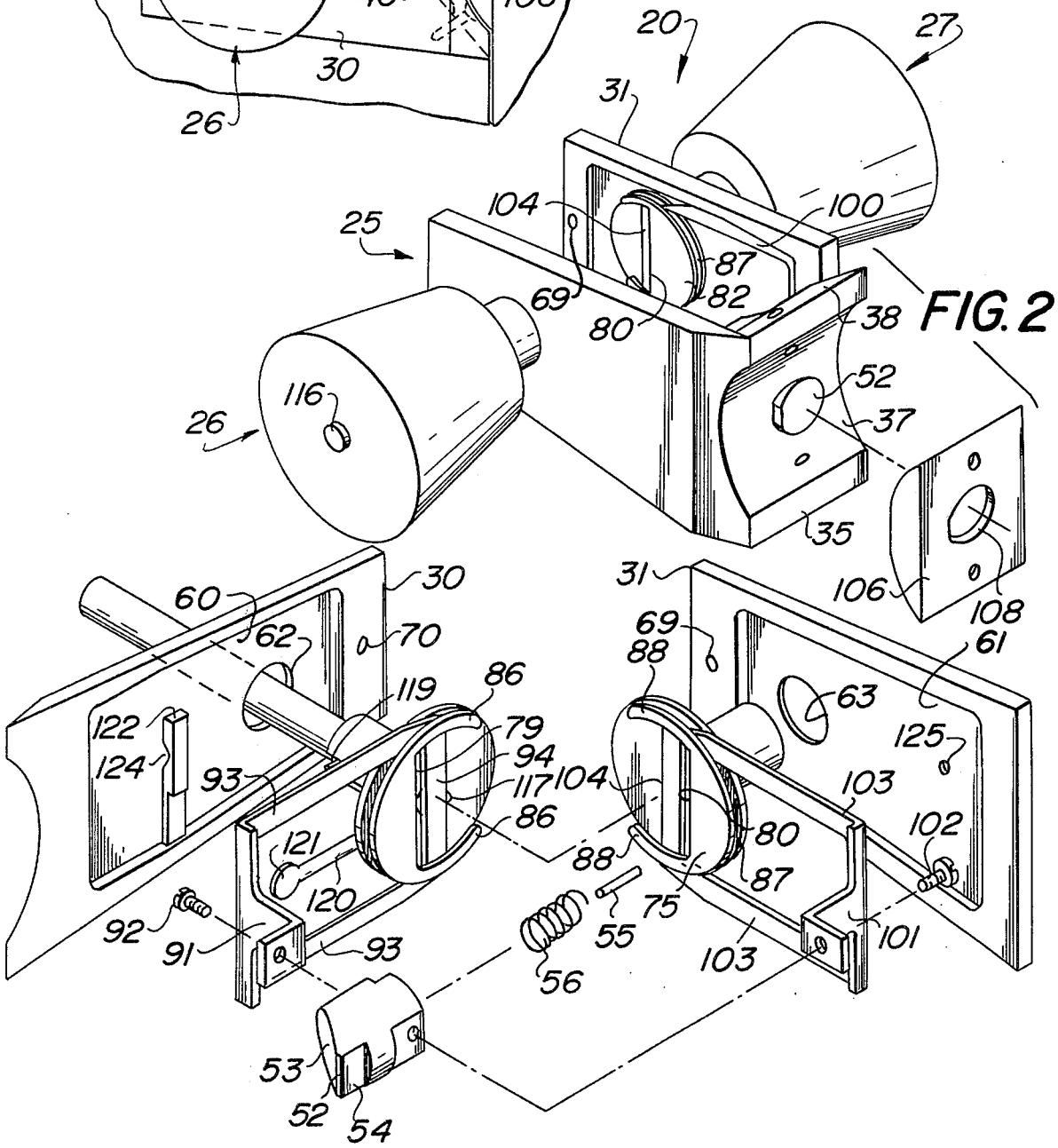
FIG. 2
FIG. 3

DOOR LOCK

BACKGROUND OF THE INVENTION

As is well known to those versed in the art, conventional door locks or lock-sets for doors involve considerable installation procedure, usually at least a through hole, edge hole to the through hole, latch face recess, all formed in the door, even before any installation of the actual lock structure, and in addition to installation of the strike. Thus, door lock installation required considerable skill, and was a time-consuming procedure, resulting in relatively high cost.

SUMMARY OF THE INVENTION

It is, therefore, an important object of the present invention to provide a door lock construction which overcomes the above-mentioned difficulties, permits of very quick and extremely simple installation, without any hole forming whatever, so that there is effected substantial savings in time and money of installation, with little or no weakening of the door.

It is another object of the present invention to provide a door lock of the type described and having the advantageous characteristics set forth in the preceding paragraph, which is inherently durable and reliable by effectively integrally uniting the structure of escutcheon plates and latch faces in a single unitary structure, which structure is adapted for uniquely attractive design, and wherein is provided a highly staunch door lock well adapted to resist abuse throughout a long useful life.

It is a more particular object of the present invention to provide a door lock construction which operates with a minimum of friction for enhanced durability, and which is adapted to be quickly, easily and silently locked from the inside, while permitting of automatic unlocking from the inside and emergency unlocking from the outside, if required.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is an elevational view partially illustrating a door and jamb, on the inside thereof, including a door lock constructed in accordance with the teachings of the present invention.

FIG. 2 is a perspective view showing a door lock of FIG. 1 apart from the door and jamb.

FIG. 3 is an exploded perspective view showing the door lock of FIG. 1.

DESCRIPTION OF THE PREFERRED EMBODIMENT

Figure 4:
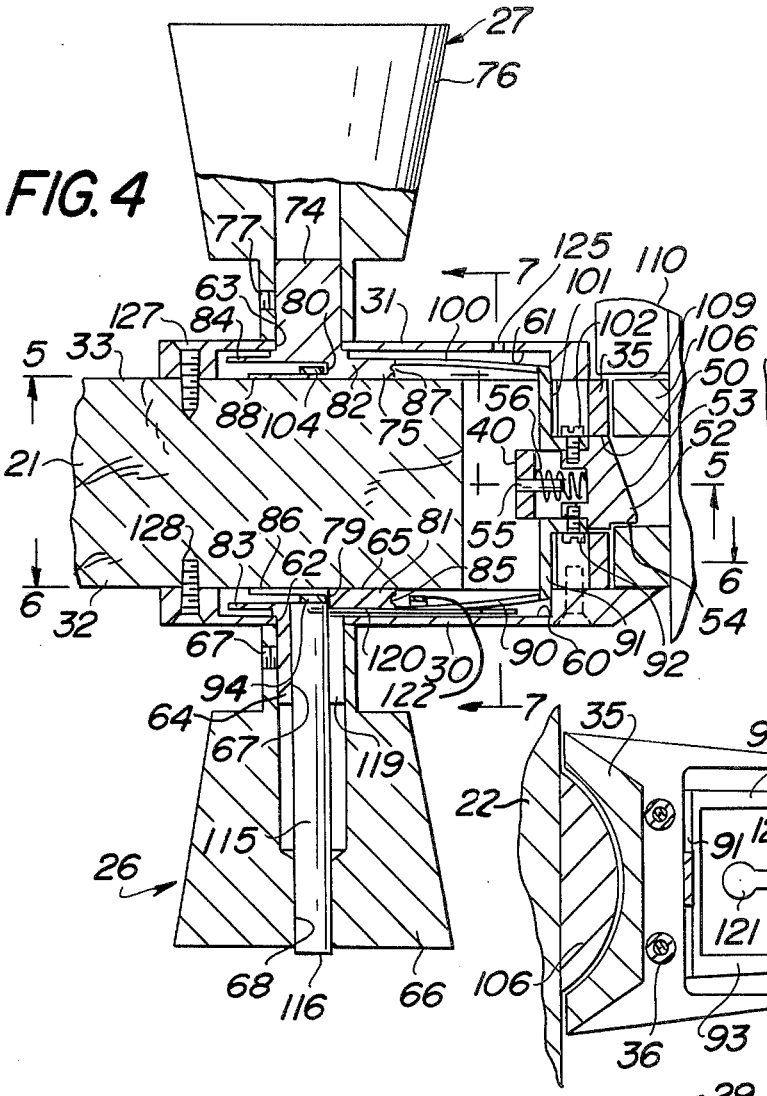
FIG. 4 is a horizontal sectional view taken generally along the line 4—4 of FIG. 1.
Figure 7:
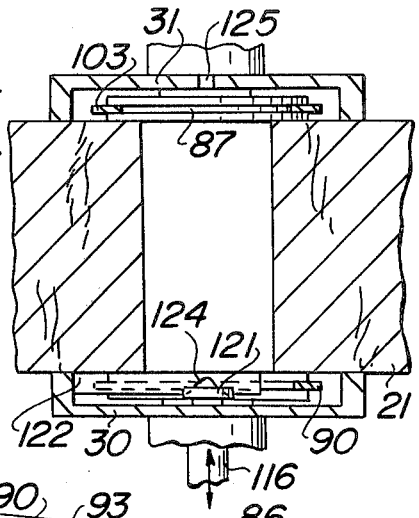
FIG. 7 is a sectional elevational view taken generally along the line 7—7 of FIG. 4.
Figure 6:
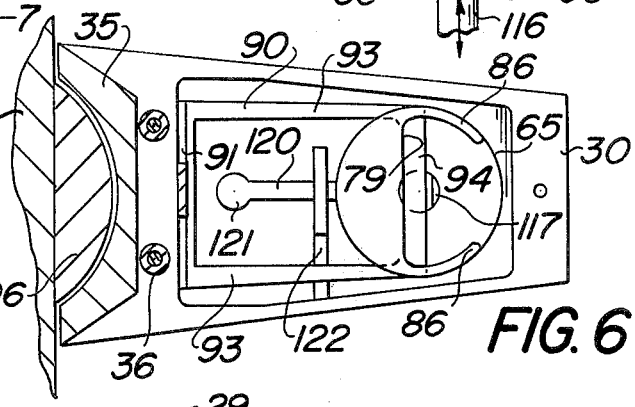
FIG. 6 is a sectional elevational view taken generally along the line 6—6 of FIG. 4.

Referring now more particularly to the drawings, and specifically to FIGS. 1 and 2 thereof, a door lock or lock set is there generally designated 20, and shown in FIG. 1 as mounted on a door 21 adjacent to a door jamb 22.

In FIG. 2 it may be seen that the door lock 20 includes a generally U-shaped main frame or body 25 and a pair of opposed, outstanding manual actuating means or knobs 26 and 27 projecting from opposite sides of the body. The U-shaped body 25 is adapted to be mounted in embracing engagement about an edge 29 of the door 21. That is, the door edge 29 is the swinging edge of door 21 remote from the hinged edge thereof, and the U-shaped lock body 25 is astride the swinging door edge 29. As will appear more fully hereinafter, the straddle mode of door lock mounting avoids the need for drilling any holes, as required by prior art constructions.

The U-shaped lock body 29 includes a pair of generally parallel legs or side pieces 30 and 31, each being generally planar and located on opposite sides of the door 21 in facing engagement therewith. In particular, the planar side piece 30 is located in facing engagement with the inside surface 32 of door 21, defining an inside face part or escutcheon, while the other side piece 31 is located in facing engagement with the outside door surface 33 and thereby provides an outside face part or escutcheon. The knob 26 projects inwardly from the inside face part 30 and thereby provides inside manual actuating means, while the knob 27 projects from the outside face part 31 to provide outside manual actuating means.

The U-shaped body 25 further includes an intermediate or bridging part 35 extending transversely of and between one adjacent pair of ends of the face parts 30 and 31, across or bridging the door edge 29. The face parts 30 and 31, and intermediate or bridging part 35 may be suitably formed as desired, say separately, as illustrated, and bolted together by suitable fastener or tie means 36. The bridging member 35 has its outer surface formed with a generally arcuately concave or partially cylindrical recess 37 which defines a groove extending transversely across the door edge 29 and having its opposite ends open. The upper and lower surfaces 38 and 39 of the bridging member 35 are disposed obliquely to each other and converge inwardly from the door edge 29 to terminate in an inner bridging member surface 40 which may extend generally vertically. That is, the upper bridging member surface 38 declines inwardly while the lower bridging member surface 39 inclines inwardly, both terminating in the inner surface 40. Further, the upper surface 38 of bridge part 35 has its inner portion 57 stepped downwardly or offset inwardly from and in parallelism with its outer portion, while the lower bridge member surface 39 similarly has its inner portion 58 stepped upwardly or offset inwardly in parallelism with its outer portion. It will thus be apparent that mounting of the door lock 20 on the door 21 requires only the cutting of an edge notch in the door as bounded by upper and lower angularly disposed surfaces 45 and 46, see FIG. 1. That is, the cutout or notch surfaces 45 and 46 may extend obliquely inwardly and toward each other from door edge 29 to an internal meeting line or corner 47, to thereby define a generally triangular edge notch in the door. The precise accuracy of the door notch is not critical, as the inner bridge member surface portions 57 and 58 are clear of or free from the door notch surfaces 45 and 46.

The bridging member 35 is formed centrally therein with a noncircular blind hole or bore 50, opening into the recess 37. The hole 50 terminates at its inner end in an end wall 51 adjacent to and spaced outwardly from the inner bridging member surface 40. A locking pin or bolt 52 is of a cross-section conformably received in bore 50, and slidably extensile and retractile therethrough. The bolt 52 may have its outer end formed with an oblique surface 53 and a longitudinal surface 54 intersecting with the oblique surface. The bolt 52 is thus longitudinally slidable in the bore 50, see FIGS. 4 and 5, and resiliently biased by a coil compression spring 56 surrounding the pin 55 and interposed between the bolt 52 and end wall 51. The bolt 52 is thereby resiliently biased to its outward position and yieldably depressible to its retracted position. As will appear presently, stop means are provided to limit extension or projection of the bolt 52.

Provided in the escutcheon plates or face parts 30 and 31 may be fastener receiving means, such as holes 69 and 70, respectively. The inner side of each escutcheon plate or face part 30 and 31 is recessed or hollow, as at 60 and 61, which hollows are open and face toward each other. In the mounted condition, the hollows 60 and 61 respectively open toward and are closed by the inside and outside door surfaces 32 and 33. The face part 30 is provided with a hole or through opening 62 communicating between the interior of hollow 60 and exterior of the inside face part, while a similar through opening or hole 63 is provided in the outside face part 31 communicating between the interior hollow 61 and exterior thereof. A rotary shaft or shank 64 is journaled or supported in the hole or opening 62 having on its inner end an internal enlargement or head 65 of generally circular or disc-like formation retaining the shank 64 associated with the face part 30 while permitting shank rotation relative to the face part. A hand grip member or knob 66 is suitably affixed to the shank 64, as by a set screw 67 or other suitable fastening means, and affords manual means for actuating the shank to rotate the same. The shank 64 includes a longitudinal through bore or hollow 67 concentric with the shank and having its opposite ends open. Further, the handgrip member or knob 66 is formed with a hollow through bore or passageway 68 in alignment with the shank bore or passageway 67, for purposes appearing more fully hereinafter.

The manual actuating means 27 is similar to the manual actuating means 26, including an internally headed rotary shaft or shank 74 extending through and journaled in opening 63, having an enlargement or disc-like head 75 on its inner end within the hollow 61. A handgrip member or knob 76 is carried by the shank 74, secured thereto by a set screw 77 or other suitable means.

The internal heads 65 and 75 are thus rotatable about the axes of their respective shanks 64 and 74 by rotation of the appropriate knob 66, 76. In practice, the shanks 64 and 74 may be coaxial with each other. Further, the internal enlargements or heads 65 and 75 may each be configured to provide a generally chordally extending cam surface or edge, as at 79 and 80, respectively, which surfaces normally face generally away from the bridging part 35. More specifically, each generally chordal cam or surface 79, 80 may be located slightly offset from the central rotary axis of the carrying head 65, 75 in the direction toward the bridging member 35. By this construction, the slightly less than semicircular portion of each head 65 and 75 toward the bridging member 35, respectively designated 81 and 82, is of substantial thickness, while the remaining, slightly greater than semicircular portions 83 and 84 of respective heads 65 and 75 remote from the bridging part 35 are of reduced thickness. It is the relative offset of the inner surface of reduced thickness portion 83 of head 65 with respect to the greater thickness portion 81 which defines the chordal edge surface or cam 79. Similarly, the chordal edge surface or cam 80 is defined by the offset between the greater thickness portion 82 of head 75 in relation to its reduced or lesser thickness portion 84.

In addition, the relatively thicker head portion 81 may have its arcuate peripheral surface externally grooved, as at 85, and may be provided with a pair of arcuate retainer arms 86 extending from opposite extremities of the cam surface 79, spaced from the reduced portion 83 generally along the head periphery toward and terminating short of each other. Similarly, the head 75 may be provided on the arcuate peripheral edge of its thicker portion 82 with an external groove 87, and on its cam surface 80 with a pair of arcuate retainer means or arms 88 extending from distal ends of the cam 80, spaced from the reduced thickness head portion 84, generally toward and terminating short of each other.

A connecting member or link 90 is connected between bolt 52 and rotary head 65 to transmit motion therebetween. The connecting member 90 includes a generally rectangular open link having a transverse arm 91 connected by suitable means, such as fastener 92, to bolt 52. The arm 91 terminates in the recess 60 adjacent to bridging member 35, and from the arm there extend a pair of spaced, longitudinally extending side pieces 93 which pass on opposite sides of the rotary member or head 65 in groove 85. Extending between the ends of the side pieces 93 is a lateral member or cam follower 94. The cam follower 94 in a rest position extends along and in engagement with the cam surface 79, between the reduced thickness head portion 83 and arms 86.

Thus, upon rotation of the head 65 in either direction, as effected by the knob 66, the follower 94 rides on the cam 79 to shift the connecting member 90 away from bridging member 35 and retract the bolt 52. Thus, the cam 79 includes a component of motion longitudinally of bolt movement which effects withdrawal of the bolt against the force of spring 56 to a limiting position with the bolt fully retracted in bore 50.

The recess 61 of outside part 31 is similarly provided with a connecting member or link 100 in motion transmitting relation between bolt 52 and rotary member or head 75. The connecting member 100 includes a transverse arm 101 suitably affixed to bolt 52, as by fastener 102, and further includes a pair of longitudinal members or side pieces 103 extending within the recess 61 longitudinally of each other from the arm 101 away from the bridging member 35 on opposite sides of the head 75 and received in the peripheral groove 87. Connecting the ends of the side pieces 103 is a laterally extending member or follower 104 which, in its normal rest condition, extends along and rests on the cam 80 between the reduced head portion 84 and retainer arms 88. Here also, the cam surface 80 includes a motion component parallel to the direction of movement of bolt 52, so that rotation of knob 76 and head 75 effects withdrawal of the bolt through link 100. When one or the other of knobs 66 and 76 are rotated to effect bolt retraction, it will be apparent that both connecting links 90 and 100 will be shifted, but only the actuated knob will move. It will be noted that the links 90 and 100 are slightly bowed toward their respective arms 91 and 101, which configuration is advantageous in achieving freedom from binding.

Figure 5:
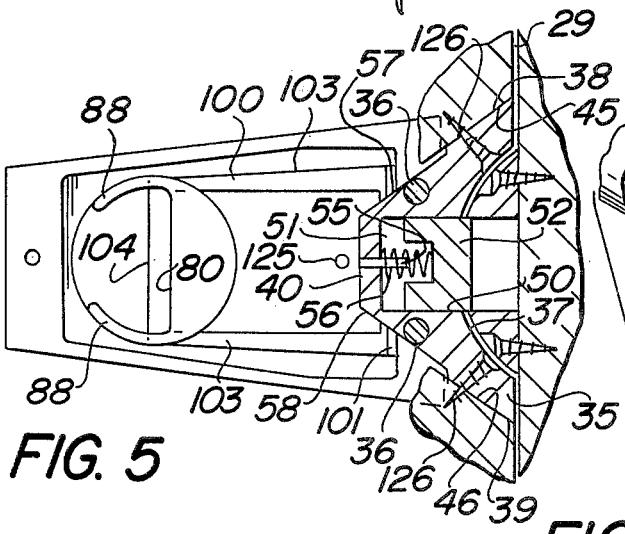
FIG. 5 is a sectional elevational view taken generally along the line 5—5 of FIG. 4.

Affixed to the door jamb 22 may be a strike or strike plate 106, which may have an exposed surface 107 arcuate for conforming reception in the recess 37. Also, the strike 106 is provided with an opening or hole 108 for conforming reception of the projecting end of bolt 52. This is best seen in FIGS. 4 and 5. It will also there be seen that one escutcheon plate or face part, say the face part 31 may be cut away or notched, as at 109 for receiving a door stop 110.

It will now be appreciated that rotation of either knob 66 or 76, in either direction of knob rotation will, by the internal connecting linkage, effect retraction of bolt 52 from strike hole 108 and permit opening movement of door 21 away from stop 110. Also, the door 21 is swingable to closed position, upon which the bolt inclined surface 53 rides on strike 106 for retraction into hole 50 against the force of spring 56 and snap engagement therefrom into strike hole 108.

In addition, the aligned through holes 67 and 68 of shank 64 and knob 66 receives therein a slidably shiftable locking member or pin 115 which includes an actuating end 116 projectable beyond the knob 66. On the inner end of locking member 115 remote from the actuating end 116, there is provided a projection, lip or tit 117, which may be off-center or eccentric with respect to the locking member. With the locking member having its actuating end 116 depressed flush with the adjacent surface of knob 66, the lip or tit projects inwardly across the path of movement of cam follower 94 to prevent movement of the latter sufficient to withdraw bolt 52. That is, upon inward insertion or depression of locking member or pin 115, the lip or tit 117 projects inward across the path of movement of cam follower 94, so that rotation of knob 76 is restrained by limiting engagement of lip 117 with cam follower 94. This restraint precludes withdrawal of bolt 52 from strike hole 108. In the normal extended position of locking member 115, as illustrated in FIG. 4, the lip 117 is retracted in the passageway 67 out of the path of movement of cam follower 94, so that retractile movement of bolt 52 is unobstructed and may be effected by rotation of either knob 66, 76 in either direction thereof.

Figure 8:
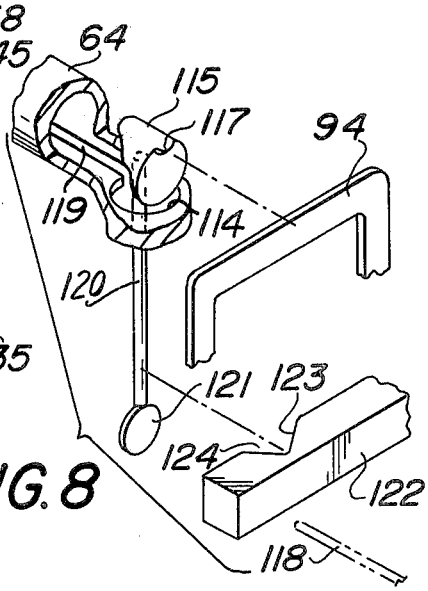
FIG. 8 is a partial perspective, exploded view illustrating interior details of the instant lock.

Extending from the inner end region of locking member 115, generally normal thereto, is a releasing arm or extension 120 which terminates in a generally flat end enlargement or disc 121 spaced between connecting link side pieces 93, adjacent to and spaced from arm 91. The releasing extension or arm 120 is essentially rigid with locking member or pin 115, and so shifts inward with the latter upon movement to locking position of the locking member, and outward with the locking member upon shifting movement to its releasing position. The releasing extension or arm 120 shifts within an elongate, generally keyhole-shaped slot 119 formed in and opening generally downwardly through the hollow shank 64, see FIG. 8, which slot terminates in an enlarged, generally round inner end portion 114. Inward depression of the locking member 115 to its locking position shifts the releasing member 120 toward a position proximate to the arcuate edge of slot enlargement 114, for a purpose appearing presently.

Also within the recess or hollow 60 of inside face part 30 is a guide member 122 suitably fixed relative to the inside face part extending transversely across an intermediate region of releasing extension 120. The guide member is formed with oblique guide surface 123 defining a recess 124. The guide member 122 is spaced from the wall of hollow 60, so that releasing extension 120 is freely rotatable with its locking member 115 and associated actuating means 26 when the locking member is in its nonlocking position. However, when the locking member 115 is shifted to its locking position, the releasing extension 120 enters into recess 124 of guide member 122. As noted hereinbefore, rotation of outside knob 76 sufficient to withdraw bolt 52 is prevented by limiting engagement of locking member projection 117 with follower 94. The lock 20 is thereby locked from the outside. However, upon rotation of the inside knob 66, the hollow shank 64 rotates with the knob, while the releasing extension is effectively held against undue rotation by location within the recess 24. However, as noted hereinbefore, the curved edge surface of slot and enlargement 114, which rotates with shank 64 and knob 66, is proximate to and engages the adjacent portion of releasing extension 120 to cam actuate the latter and shift the same outward. This shifts the extension 120 out of recess 124, simultaneously shifting locking member 115 outwardly and locking member projection out of its overlying, locking relation with respect to cam follower 94. Thus, the elements return to an unlocked condition permitting further rotation of knob 66 for its complete unlocking action.

If desired, say in emergency, to unlock the door lock 20 from outside of the door 21, this is readily achieved through an access hole 125 in the outside face part 31. More particularly, a rod or elongate stiff member may be inserted through the access hole 125, which is directly opposite to the release member end enlargement or disc 121, into engagement with the latter to shift the release member and associated locking member 115 out of the locking position. Such a probing member will pass freely through the door cutout or notch between cut surfaces 45 and 46. See probe 118, shown in phantom in FIG. 8.

For high security, the body 25 is mounted on the door 21 by fasteners 126 extending through the bridging part 35 into the door through cut surfaces 45 and 46. While additional fastener means may be provided, such as fasteners 127 and 128 through outside door part 31 and inside door part 30, these may be omitted, or at least the outside fasteners may be omitted and the body 25 of sufficient rigidity, to achieve a high degree of security.

From the foregoing, it is now seen that the present invention provides a door lock construction which greatly simplifies installation, to eliminate the need for skill or training and considerably reduce installing time, with minimal mutilation and weakening of the door, and which is entirely reliable and durable throughout a long useful life and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A door lock comprising a generally U-shaped body for mounting astride a door edge, said body including inside and outside face parts for location on opposite sides of a door and a bridging part connecting said face parts and extending across the door edge, a bolt shiftably mounted in said bridging part for movement between an extended locking position and a retracted open position, inside manual actuating means rotatably carried by said inside face part, outside manual actuating means rotatably carried by said outside face part, linkage means interconnected between each of said actuating means and said bolt for selectively retracting and extending the latter upon actuating means rotation, said linkage means comprising a rotary member in the respective face part connected to the associated actuating means for rotation thereby, and a connecting member connected between said bolt and the respective rotating member for movement with the latter to shift said bolt, a locking member selectively shiftable through said inside face part between an extended release position clear of the associated connecting member and a retracted locking position extending across a path of the associated connecting member to limit movement of the latter and prevent retraction of said bolt, a releasing extension on said locking member in said inside face part and shiftable with said locking member between locking and releasing positions, and guide means fixed in said inside face part in the path of movement of said locking member extension in its locking position to shift the latter and said locking member to its releasing position upon rotation of said inside actuating means.

2. A door lock according to claim 1, in combination with access means through said outside face part affording access to said locking member extension for shifting the latter and said locking member to its release position.

* * * * *